US008177391B2

(12) United States Patent
Ryu et al.

(10) Patent No.: US 8,177,391 B2
(45) Date of Patent: May 15, 2012

(54) TUBE-TYPE OR CHANNEL-TYPE LED LIGHTING APPARATUS

(75) Inventors: Seung Ryeol Ryu, Ansan-si (KR); Sang Geun Bae, Ansan-si (KR); Seung Sik Hong, Ansan-si (KR); Kwang Ii Park, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 70 days.

(21) Appl. No.: 12/751,571

(22) Filed: Mar. 31, 2010

(65) Prior Publication Data

US 2010/0265693 A1 Oct. 21, 2010

(30) Foreign Application Priority Data

Mar. 31, 2009 (KR) ..... 10-2009-0027245

(51) Int. Cl.
*F21V 7/04* (2006.01)

(52) U.S. Cl. ..... 362/249.02; 362/326; 362/311.02; 362/296.05

(58) Field of Classification Search ..... 362/249.02, 362/249.11, 310, 311.02, 311.06, 326, 340
See application file for complete search history.

(56) References Cited

U.S. PATENT DOCUMENTS 5,471,372 A * 11/1995 Mamelson et al. ..... 362/92
6,361,186 B1 * 3/2002 Slayden ..... 362/241
7,186,005 B2 * 3/2007 Hulse ..... 362/255
7,385,653 B2 * 6/2008 Kim et al. ..... 349/61
7,674,010 B2 * 3/2010 Griffiths et al. ..... 362/249.02
7,850,341 B2 * 12/2010 Mrakovich et al. ..... 362/249.06
7,909,486 B2 * 3/2011 Kim ..... 362/335

* cited by examiner

*Primary Examiner* — Anabel Ton
(74) *Attorney, Agent, or Firm* — H.C. Park & Associates, PLC

(57) ABSTRACT

A light emitting diode (LED) lighting apparatus that may be used as interior lighting or advertisement lighting is disclosed. The LED lighting apparatus includes a channel-type or tube-type optical housing with a light emission surface and an LED array arranged in the optical housing. The light emission surface includes a valley line and a first inner ridge and a second inner ridge disposed on opposing sides of the valley line, and the LED array includes a plurality of LEDs whose centers are arranged along the valley line.

17 Claims, 16 Drawing Sheets

(a)

(b)

TUBE-TYPE OR CHANNEL-TYPE LED LIGHTING APPARATUS

CROSS REFERENCE TO RELATED APPLICATION

This application claims priority from and the benefit of Korean Patent Application No. 10-2009-0027245, filed on Mar. 31, 2009, which is hereby incorporated by reference for all purposes as if fully set forth herein

BACKGROUND OF THE INVENTION

1. Field of the Invention

Exemplary embodiments of the present invention relate to a light emitting diode (LED) lighting apparatus using LEDs and, more particularly, to an LED lighting apparatus having a tube-type or channel-type optical housing.

2. Discussion of the Background

For a long time, a cold cathode fluorescent lamp, referred to as a "fluorescent lamp," has been used as a lighting apparatus for brightening and illuminating interior spaces in commercial buildings, houses, and interior spaces in transportation means such as airplanes, automobiles, ships, trains, and subway trains. However, the cold cathode fluorescent lamp may have disadvantages such as a short life span, poor durability, limited range of light colors, and low energy efficiency.

Recently, similar to cold cathode fluorescent lamps, a tube-type LED lighting apparatus comprising a generally circularly-shaped, elongated light-transmissive tube and a plurality of LEDs arranged in the light-transmissive tube has been developed. Compared to a cold cathode fluorescent lamp, such a tube-type LED lighting apparatus may have advantages that include a longer life span, better durability, a wider range of light colors, and greater energy efficiency.

However, the conventional tube-type LED lighting apparatus also may be disadvantageous due to intrinsic characteristics of the LEDs used as a light source. Some of the characteristics include the considerably straight, slightly divergent light emitted from the LEDs that impinges on the circular surface of the tube, thereby producing a Lambertian light emission angular distribution pattern, i.e., a light emission angular distribution pattern with a narrow angular range. Accordingly, the conventional tube-type LED lighting apparatus may have many technical limits for replacing the conventional cold cathode fluorescent lamp when used for interior lighting.

Additionally, a channel-type LED lighting apparatus has recently been used. Here, a plurality of LEDs is longitudinally arranged in an elongated channel with an open front face instead of the tube as described above. The inner volume of the channel is filled with a light-emissive resin material, or a transparent glass or plastic is arranged on the front face of the channel. Due to the narrow angular distribution of light emission from an LED from its flat light emissive surface, the above channel-type LED lighting apparatus may be subject to serious light losses caused by the internal reflection of the channel, and such apparatus have been used chiefly as advertisement lighting for displaying letters, numerals, marks, logos, and symbols instead of lighting for brightening and illuminating interior spaces. Even for channel-type LED lighting apparatus used in advertisement lighting, the low light efficiency of the channel-type LED lighting apparatus may be a drawback. Accordingly, ways to reduce the light losses for the channel-type LED lighting apparatus are sought.

Other conventional tube-type and channel-type LED lighting apparatus employ an LED package article for emitting white light generated by a combination of a phosphor and an LED chip, particularly an LED chip emitting blue-colored light matched with an appropriate phosphor. However, as the operating on-time of the LED lighting apparatus increases, the phosphor located adjacent to the LED chip in the LED package article may degrade, thereby lowering the reliability of the LED lighting apparatus. Accordingly, improvements in LED lighting apparatus such as increasing its reliability by decreasing the degradation of the phosphor are desired.

SUMMARY OF THE INVENTION

Exemplary embodiments of the present invention provide a tube-type or channel-type light emitting diode (LED) lighting apparatus capable of reducing light losses while broadening the angular distribution of emitted light, which typically is distributed in a narrow angular range near the central region of the tube or cavity above the LED.

Exemplary embodiments of the present invention also provide a tube-type or channel-type LED lighting apparatus in which a phosphor is spaced far from an LED in order to decrease the degradation of the phosphor in the LED lighting apparatus. The phosphor would otherwise be included in the LED, particularly in an LED package article.

Additional features of the invention will be set forth in the description which follows, and in part will be apparent from the description, or may be learned by practice of the invention.

Exemplary embodiments of the present invention disclose an LED lighting apparatus that comprises an optical housing and an LED array arranged in the optical housing. The optical housing comprises a light emission surface and one of a channel-type optical housing and a tube-type optical housing, and the light emission surface comprises a valley line, a first inner ridge, and a second inner ridge, the first inner ridge and the second inner ridge being disposed on opposing sides of the valley line. The LED array comprises a plurality of LEDs arranged so that a center of each LED is arranged along the valley line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
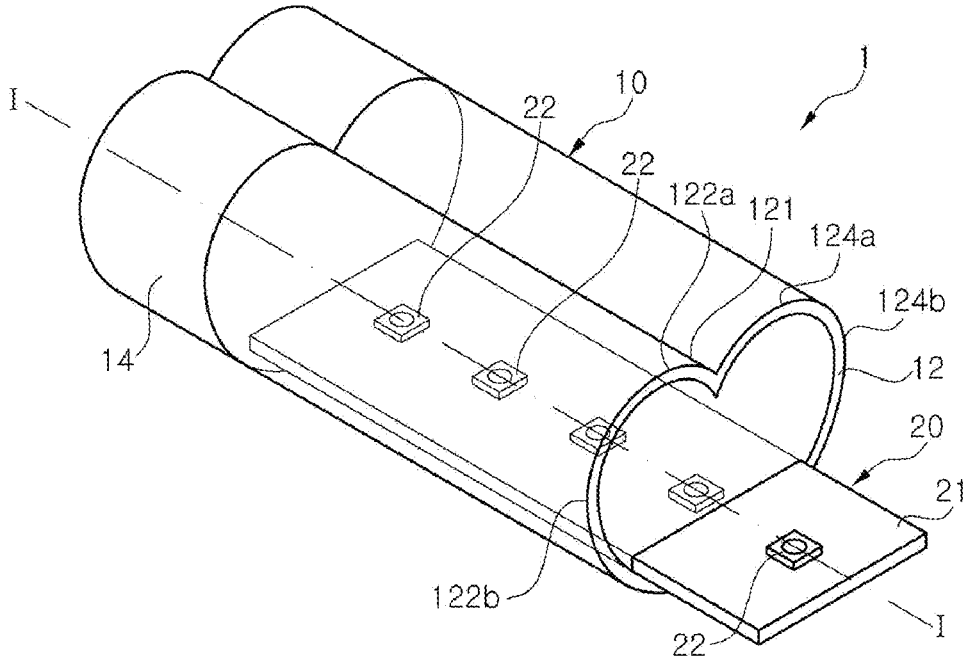
FIG. 1 is a partially cut-out perspective view showing a tube-type LED lighting apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
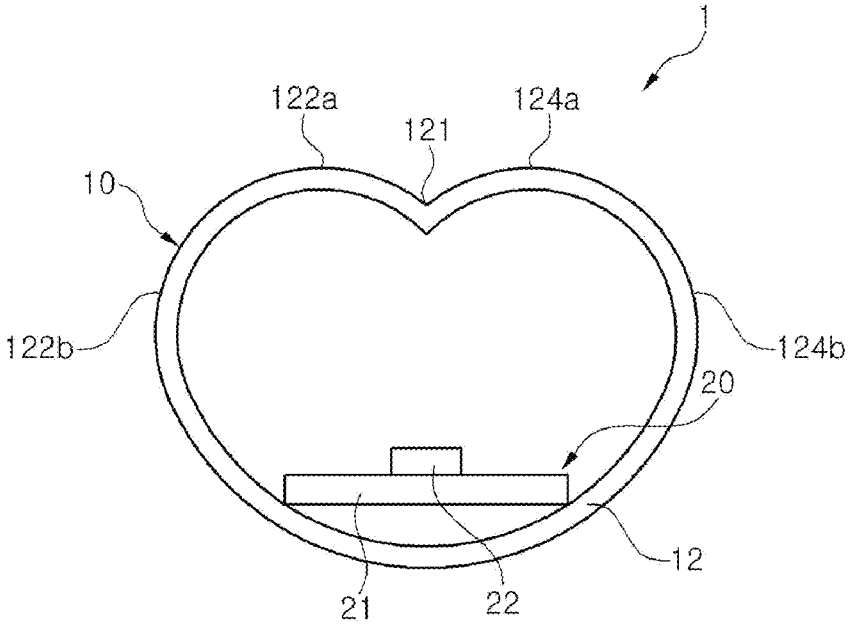
FIG. 2 is a cross-sectional view of the tube-type LED lighting apparatus shown in FIG. 1.

FIG. 1 is a partially cut-out perspective view showing a tube-type light emitting diode (LED) lighting apparatus according to an exemplary embodiment of the present invention, and FIG. 2 is a cross-sectional view of the tube-type LED lighting apparatus shown in FIG. 1.

Referring to FIG. 1, an LED lighting apparatus 1 comprises an optical housing 10 and an LED array 20 arranged in the optical housing 10.

The optical housing 10 includes an integral-type hollow tube 12 formed of transparent resin or glass, and one end of the tube 12 is closed by a connector 14 to supply power to the LED array 20. Although not shown, the other end of the tube 12 is closed by another connector, a portion of the tube 12, or another material. Further, the internal space of the tube 12 is filled with air or another gas.

A front surface, i.e., a light emission surface of the tube 12 with respect to the LED array 20, extends in the form of two peak-shaped convex portions facing each other. Accordingly, a straight valley line 121 is formed between the two convex portions. Further, a first inner ridge 122*a* and a second inner ridge 124*a*, which are two inner parts of the two convex portions, extend along the valley line 121 on both sides of the valley line 121. In addition, a first outer ridge 122*b* and a second outer ridge 124*b*, which are two outer parts of the two convex portions, are arranged facing the first and second inner ridges 122*a* and 124*a*, respectively.

As will be described below, the first and second inner ridges 122*a* and 124*a* allow emitted light to be more widely dispersed toward both sides of the valley line 121 so that the first and second inner ridges 122*a* and 124*a* may play an important role in increasing the angular distribution of the light emission. The first and second inner ridges 122*a* and 124*a* may be formed in the shape of convex curves. As with the first and second inner ridges 122*a* and 124*a*, the first and second outer ridges 122*b* and 124*b* are also formed in the shape of convex curves. The inner ridges 122*a* and 124*a* and their corresponding outer ridges 122*b* and 124*b* may be symmetric with respect to the corresponding peak.

The LED array 20 includes a plurality of LED packages 22 mounted on an elongated printed circuit board (PCB) 21. Although not shown, an LED chip may be embedded in each LED package 22, and the LED chip may be connected to conductive patterns formed on the PCB through lead terminals. The LED package 22 may include phosphors, and white light may be generated by various combinations of the LED chip and phosphors. As shown in the figures, for example FIG. 1, the LED packages 22 are disposed at regular intervals, but the present invention is not limited thereto. Further, a virtual array line I connecting the centers of the LED packages 22 may be a straight-line, but the virtual array line is not limited thereto.

As shown in FIG. 1 and FIG. 2, the LED packages 22 are positioned behind the valley line 121 and arranged on the PCB 21 in the lengthwise direction of the optical housing 10 to allow the centers of the LED packages 22 to coincide with the valley line 121. Accordingly, the valley line 121 and the array line I connecting the centers of the LED package are vertically spaced apart and are parallel to each other so that the centers of the LED packages 22 are arranged along the valley line 121. Due to the shape of the tube 12 of the optical housing 10, which includes the valley line 121, the first and second inner ridges 122*a* and 124*a*, and the arrangement of the configuration of the LED array 20 as described above, the LED lighting apparatus 1 may emit light with a wider light emission angular distribution.

Figure 3:
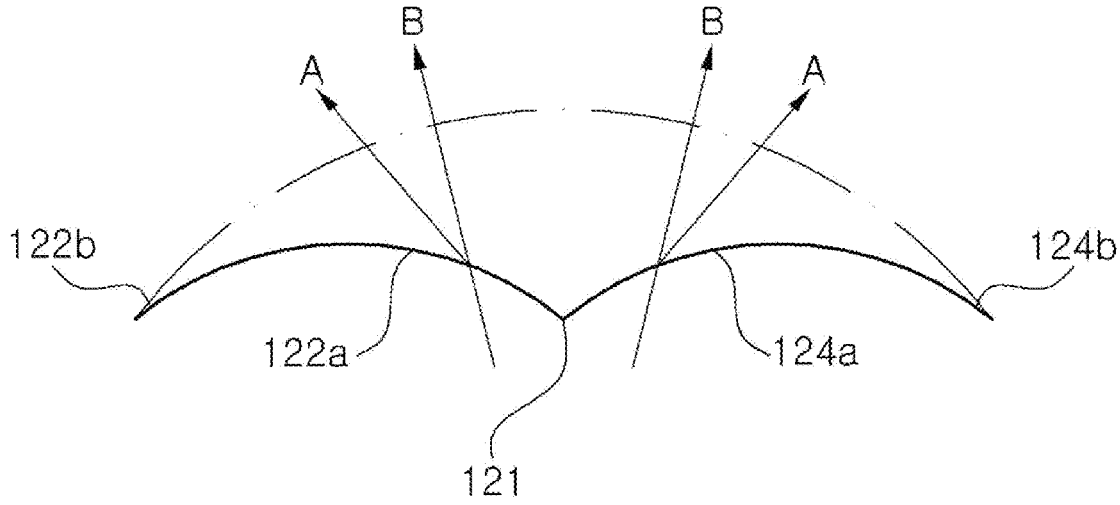
FIG. 3 is a view for comparing the light emission characteristics of the LED lighting apparatus according to an exemplary embodiment of the present invention with that of a conventional LED lighting apparatus.

FIG. 3 is a view for comparing the light emission characteristic of the LED lighting apparatus according to an exemplary embodiment of the present invention with that of a conventional LED lighting apparatus.

In FIG. 3, the light emission surface of the tube according to an exemplary embodiment of the present invention, which includes the valley line 121, the first and second inner ridges 122*a* and 124*a*, and the first and second outer ridges 122*b* and 124*b*, is indicated by a solid line, and a portion of the conventional light emission surface having a convex, circular central portion is indicated by a dashed dotted line.

Light passing through the first and second inner ridges 122*a* and 124*a* is emitted outwards far away from the valley line 121; however, light emitted initially in the same direction and passing through the conventional light emission surface is emitted outwards in a region closer to the valley line 121. The refractive index of the tube is larger than that of the air. Therefore, the light emission may be constant over the entire length of the tube 12 since, as shown in FIG. 1, the valley line 121 and the first and second inner ridges 122*a* and 124*a* are continuous along the longitudinal direction of the tube 12.

Here, the refractive index of the gas within the tube 12 differs from the refractive index of the tube 12, and the difference between the refractive indexes affects the light emission angular distribution to some degree. In order to minimize this effect, the tube 12 may be filled with the same material as that of the tube 12 or other materials having a refractive index similar to that of the tube 12. Additionally, the tube 12 may be a solid object so that no space occurs between the LED array 20 and the tube 12. Further, the considerable increase of the thickness of the tube 12 in the direction along which the light travels may contribute to the reduction of this effect as described above.

Figure 4:
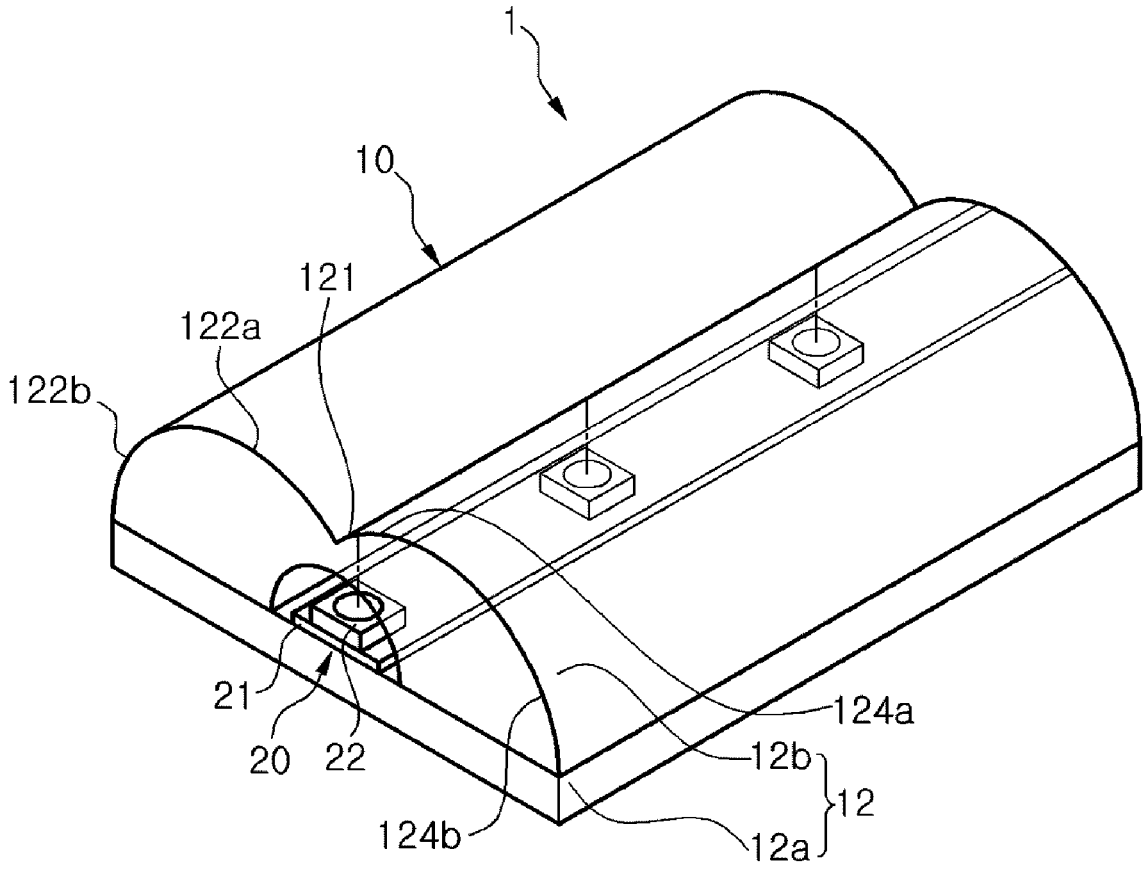
FIG. 4 is a partially cut-out perspective view showing a tube-type LED lighting apparatus according to another exemplary embodiment of the present invention.

FIG. 4 is a partially cut-out perspective view showing a tube-type LED lighting apparatus according to another exemplary embodiment of the present invention.

Referring to FIG. 4, in the tube-type LED lighting apparatus 1 according to this exemplary embodiment, a light-transmissive tube cap 12*b* is assembled onto a base 12*a* to form the tube 12 that serves as a portion of the optical housing 10. An elongated space is formed between the base 12*a* and the tube cap 12*b*, and the LED array 20 having a plurality of LED packages 22 as described above is arranged in the elongated space. A rigid PCB or a flexible PCB (FPCB) 21 may be used for mounting and for electrically connecting the plurality of LED packages 22. Compared to the aforementioned exemplary embodiment, the cross-sectional area of the space required to arrange the LED array 20 is considerably smaller while the thickness or the cross-sectional area of the tube 12 and the tube cap 12*b* is considerably larger. Further, the valley line 121, the first and second inner ridges 122*a* and 124*a*, and the first and second outer ridges 122*b* and 124*b* as described in the aforementioned exemplary embodiment are formed on the front surface of the tube cap 12*b*, i.e., the light emission surface. Accordingly, the LED lighting apparatus 1 according to this exemplary embodiment enables light from the LED packages 22 to spread toward the first and second inner ridges 122*a* and 124*a* and to emit the light outward from the valley line 121, thereby emitting the light with an enlarged light emission angular distribution pattern.

Figure 5A:
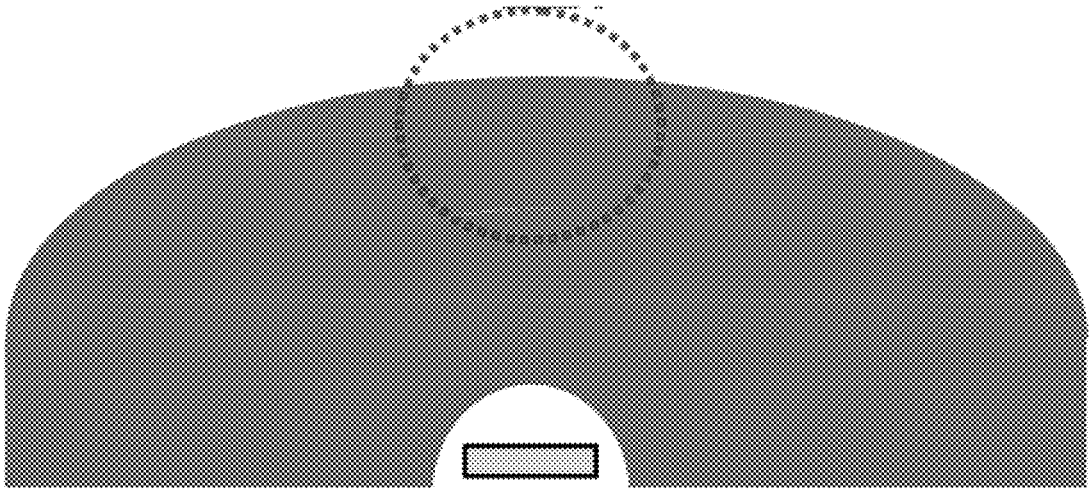
FIG. 5*a*, FIG. 5*b*, FIG. 5*c*, and FIG. 5*d* are views showing the intensity in the angular distribution of light emission for various shapes of the light emission surface of the tube.
Figure 5A:
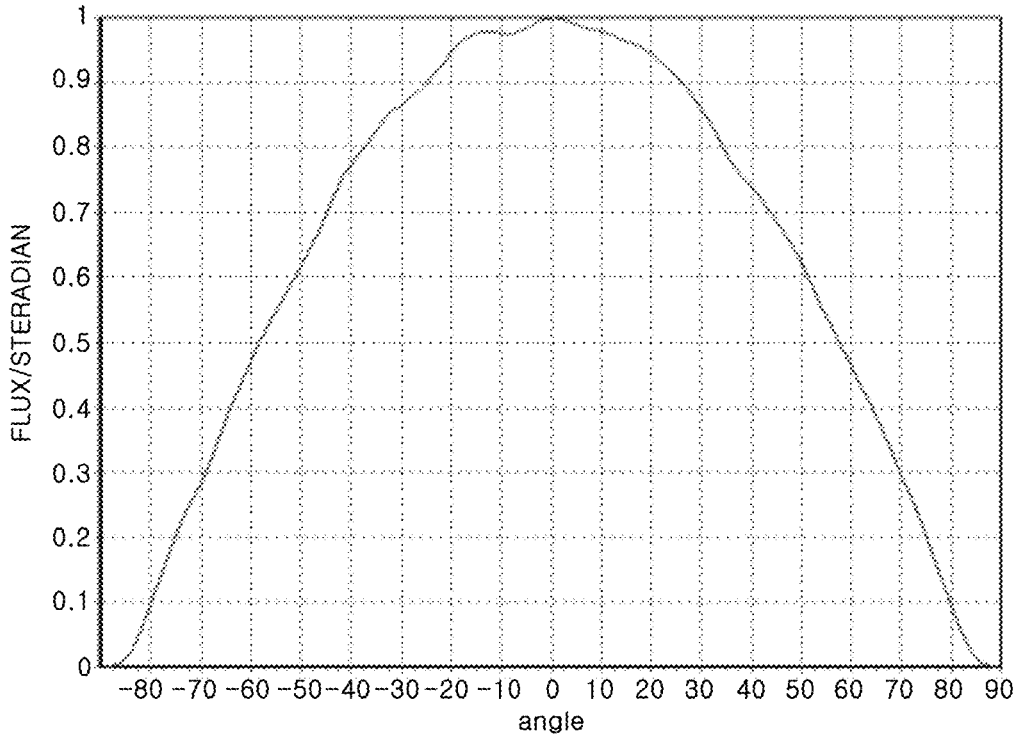
Figure 5B:
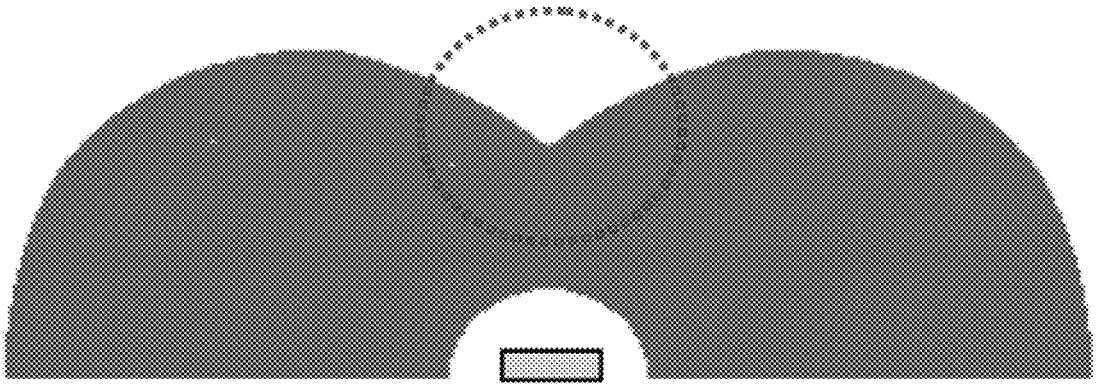
Figure 5B:
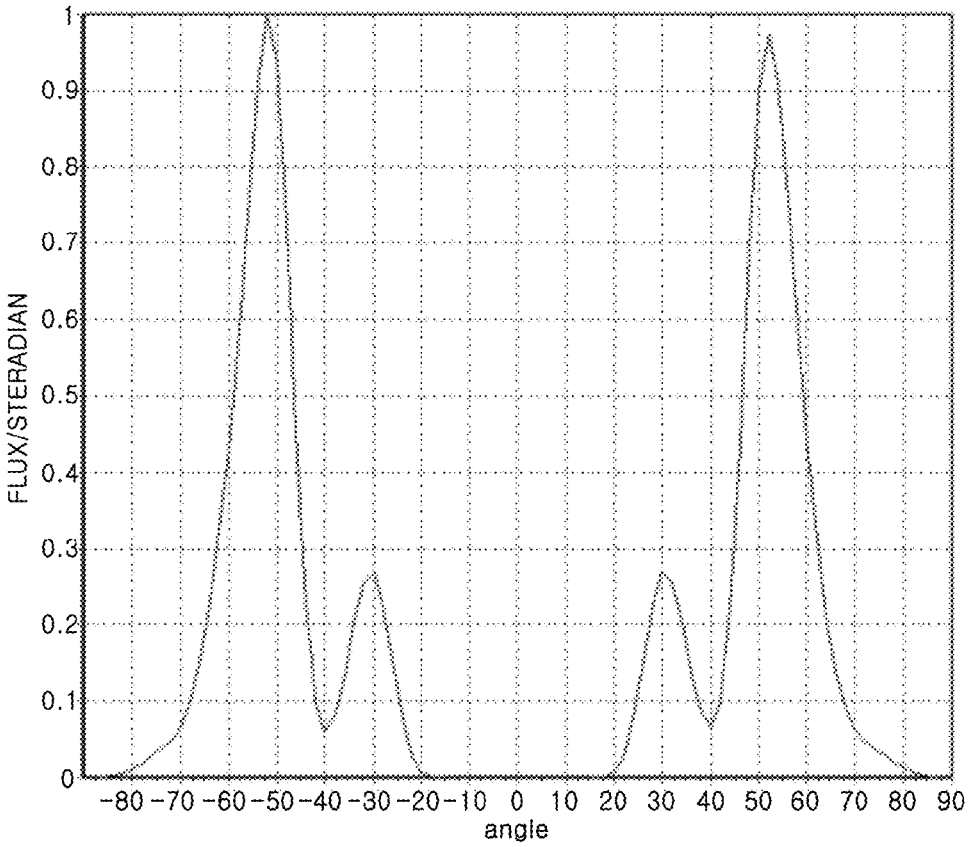
Figure 5C:
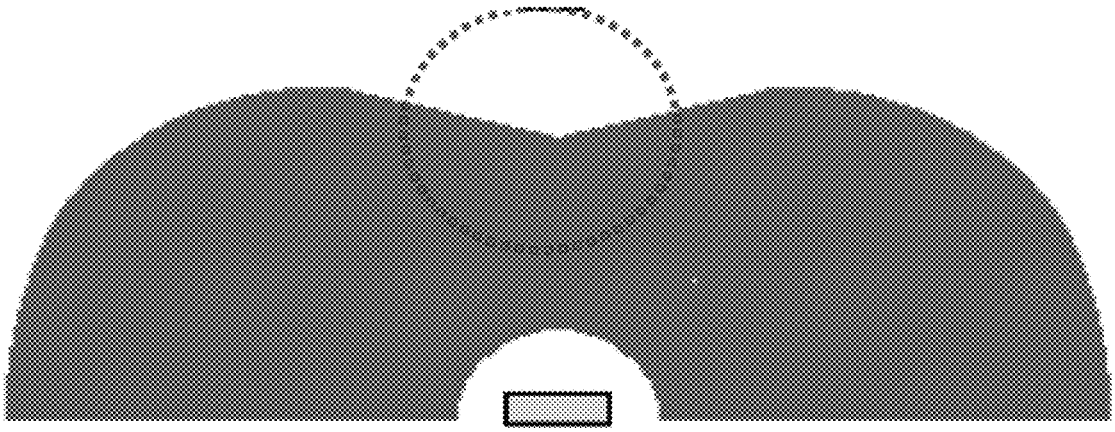
Figure 5C:
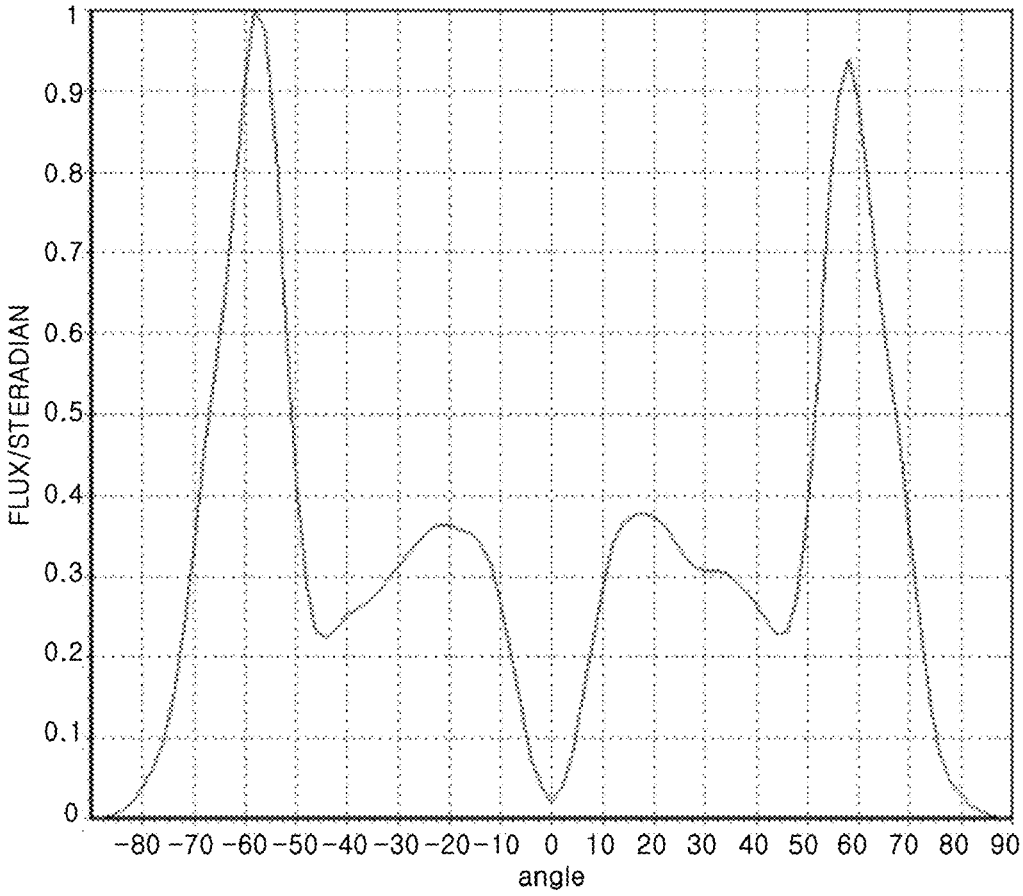
Figure 5D:
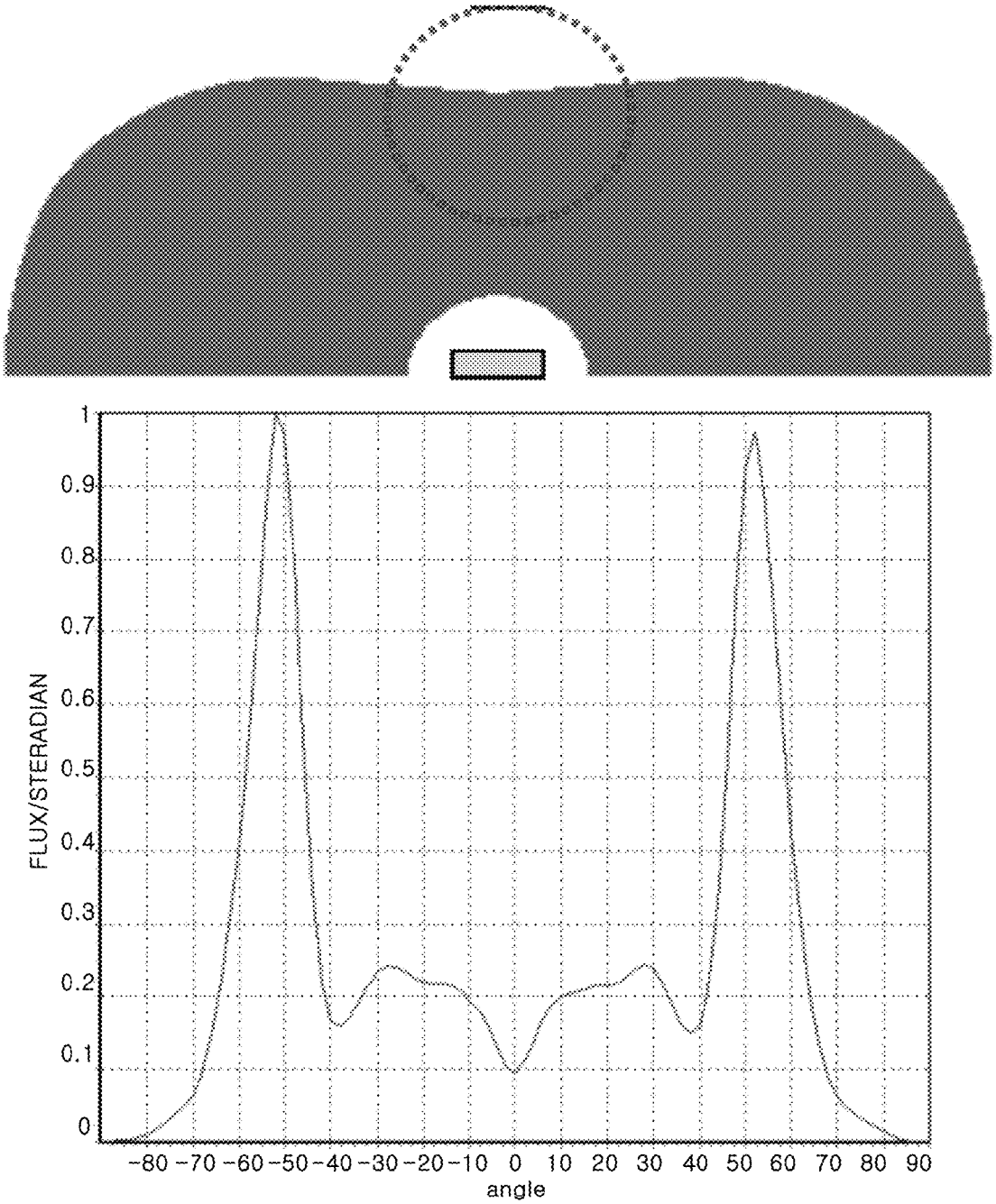

FIG. 5*a*, FIG. 5*b*, FIG. 5*c*, and FIG. 5*d* are views showing that the difference in the light emission angular distribution depends on the shape of the light emission surface of the tube. FIG. 5*a* shows the light emission angular distribution in a comparative example in which the light emission surface of the tube has neither valley line nor ridges, and FIG. 5*b*, FIG. 5*c*, and FIG. 5*d* show the light emission angular distribution in various exemplary embodiments in which the light emission surface of the tube has the valley line and the ridges. Referring to these figures, it may be understood that, unlike the conventional light emission surface in which the quantity of light is concentrated to the central region, corresponding to 0° in FIG. 5*a*, the quantity of light in the central region is reduced while the quantity of light in the peripheral region is increased considerably according to exemplary embodiments of the present invention.

Figure 6:
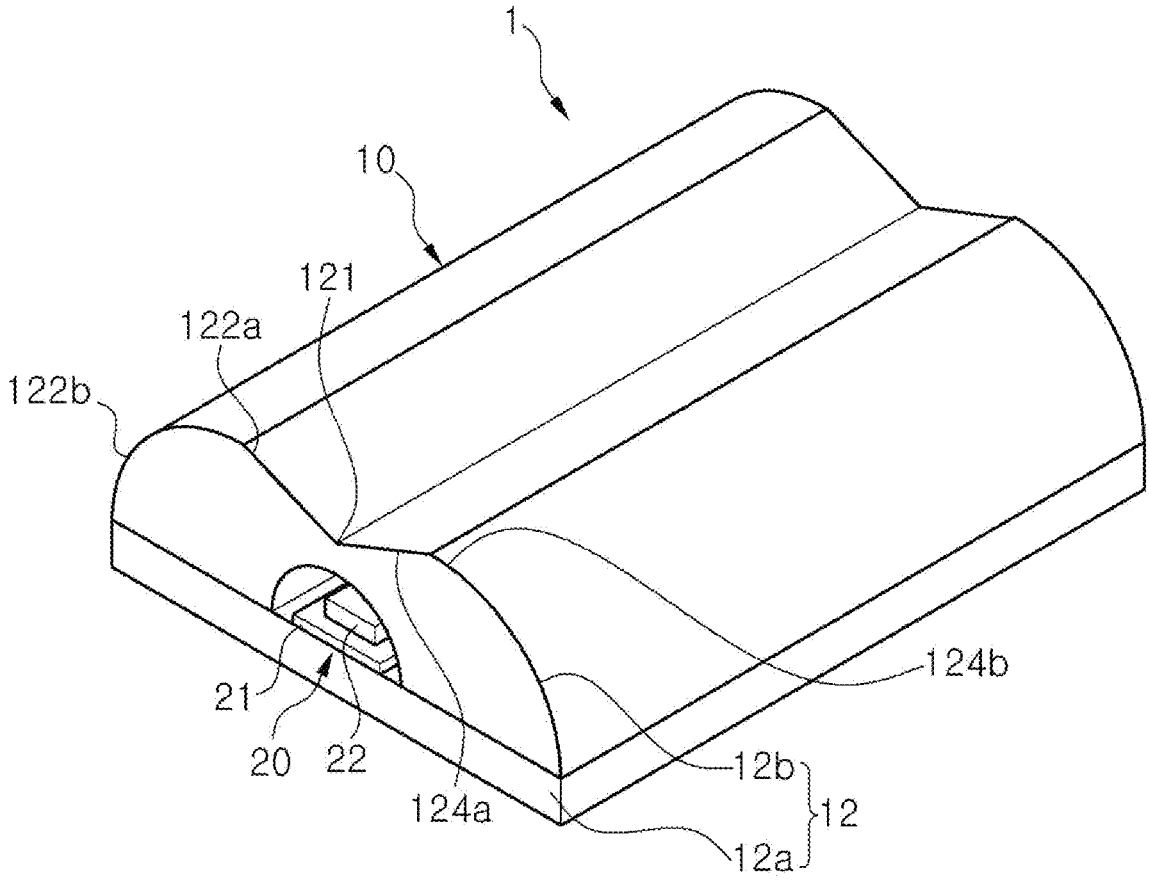
FIG. 6 is a partially cut-out perspective view showing an LED lighting apparatus with a light emission surface modified according to an exemplary embodiment of the present invention.

FIG. 6 is a partially cut-out perspective view showing an LED lighting apparatus with a light emission surface modified according to a further exemplary embodiment of the present invention. Referring to FIG. 6, it may be understood that the first and second inner ridges 122*a* and 124*a* located to the sides of the valley line 121 are formed in the shape of slanted flat surfaces instead of convex curves as in the above exemplary embodiments. Similar to the aforementioned exemplary embodiments, light emitted from the LED package 22 is bent on the flat surfaces of the first and second inner ridges 122*a* and 124*a* toward the left and right sides, respectively, and emitted outwardly away from the valley line 121. Like the aforementioned exemplary embodiments, the first and second outer ridges 122*b* and 124*b* are in the shape of convex curves.

In the first exemplary embodiment of the present invention described above, the configuration included a phosphor in the LED package. The exemplary embodiments described below with reference to FIG. 7, FIG. 8, FIG. 9, and FIG. 10 are related to improvements in which the phosphor is arranged outside the LED package in contrast to the inclusion of a phosphor in the conventional LED package.

Figure 7:
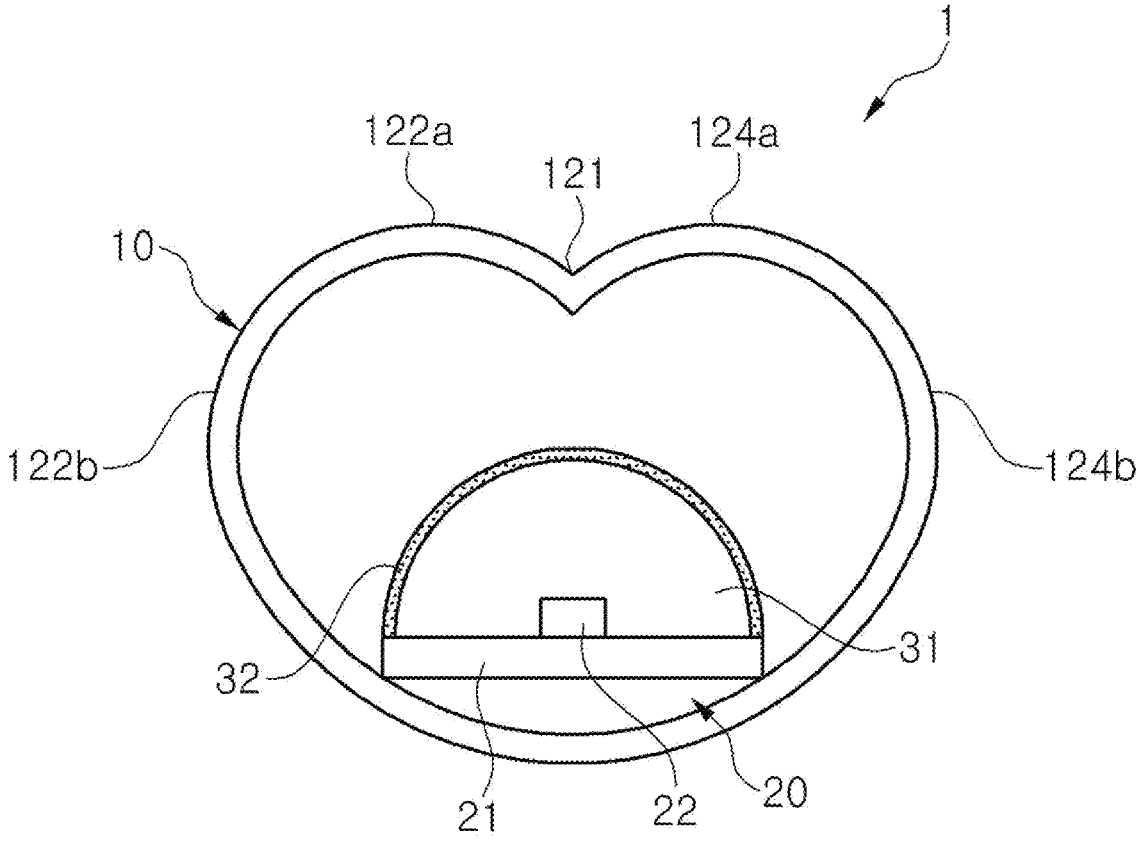
FIG. 7, FIG. 8, FIG. 9, and FIG. 10 are views showing exemplary embodiments of the present invention corresponding to various arrangements of the phosphor.

Referring to FIG. 7, a light-transmissive molding portion 31 is formed on the PCB 21 and covers individually or entirely the plurality of LED packages 22 included in the LED array 20. In addition, a phosphor 32 for converting the wavelength of the light is formed as a layer on the surface of the light-transmissive molding portion 31. As described above, the phosphor 32 is arranged outside and separated from the LED package so that phosphor degradation caused by long term exposure to light emitted from LED packages 22 may be mitigated or prevented.

Figure 8:
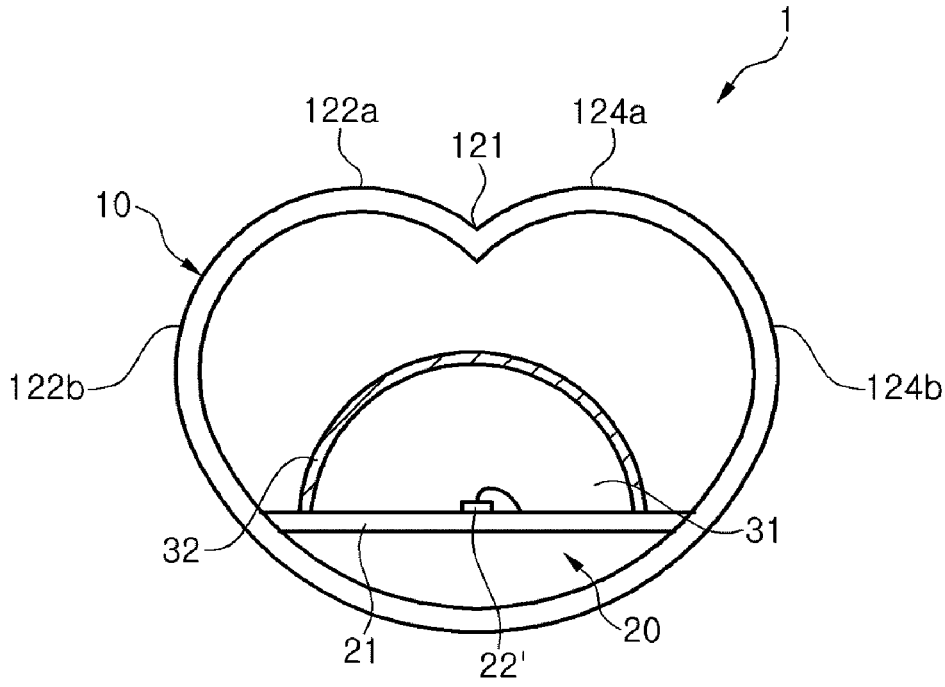
Figure 8:
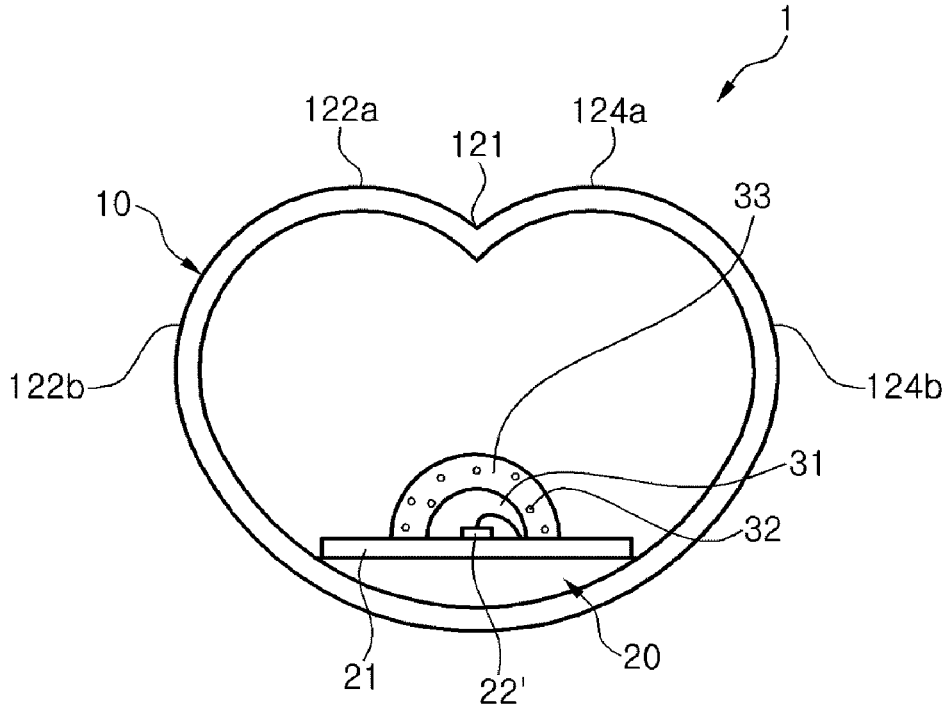

Referring to FIG. 8(*a*) and FIG. 8(*b*), instead of the LED package a bare LED chip 22' may be directly mounted on the PCB 21 to form the LED array 20. Since the phosphor 32 is disposed on the surface of the molding portion 31 and spaced far apart from the bare LED chip 22', degradation of the phosphor 32 due to long term exposure to the light emitted by the LED chip 22' may be prevented. FIG. 8(*a*) shows that the phosphor 32 is applied thinly to the surface of the light-transmissive molding portion 31, which may occur through a coating process, and FIG. 8(*b*) shows that the phosphor 32 is contained in a resin layer 33 that is formed on the surface of the light-transmissive molding portion 31 in a dual molding manner.

Figure 9:
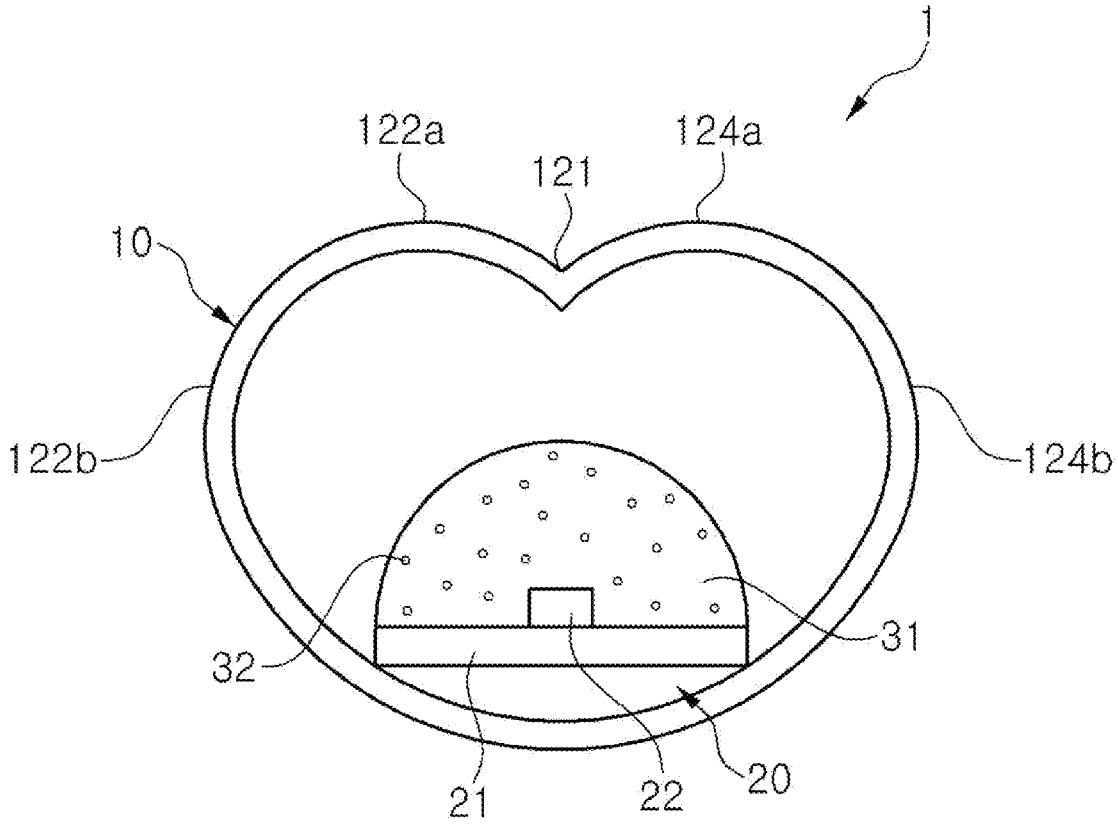

FIG. 9 shows a configuration in which the phosphor 32 is contained in the light-transmissive molding portion 31 instead of applying the phosphor 32 to the surface of the light-transmissive molding portion 31. In order to implement this configuration, the phosphor 32 may be premixed with a transmissive resin before the formation of the light-transmissive molding portion 31. The transmissive resin serves as a raw material for the light-transmissive molding 31.

Figure 10:
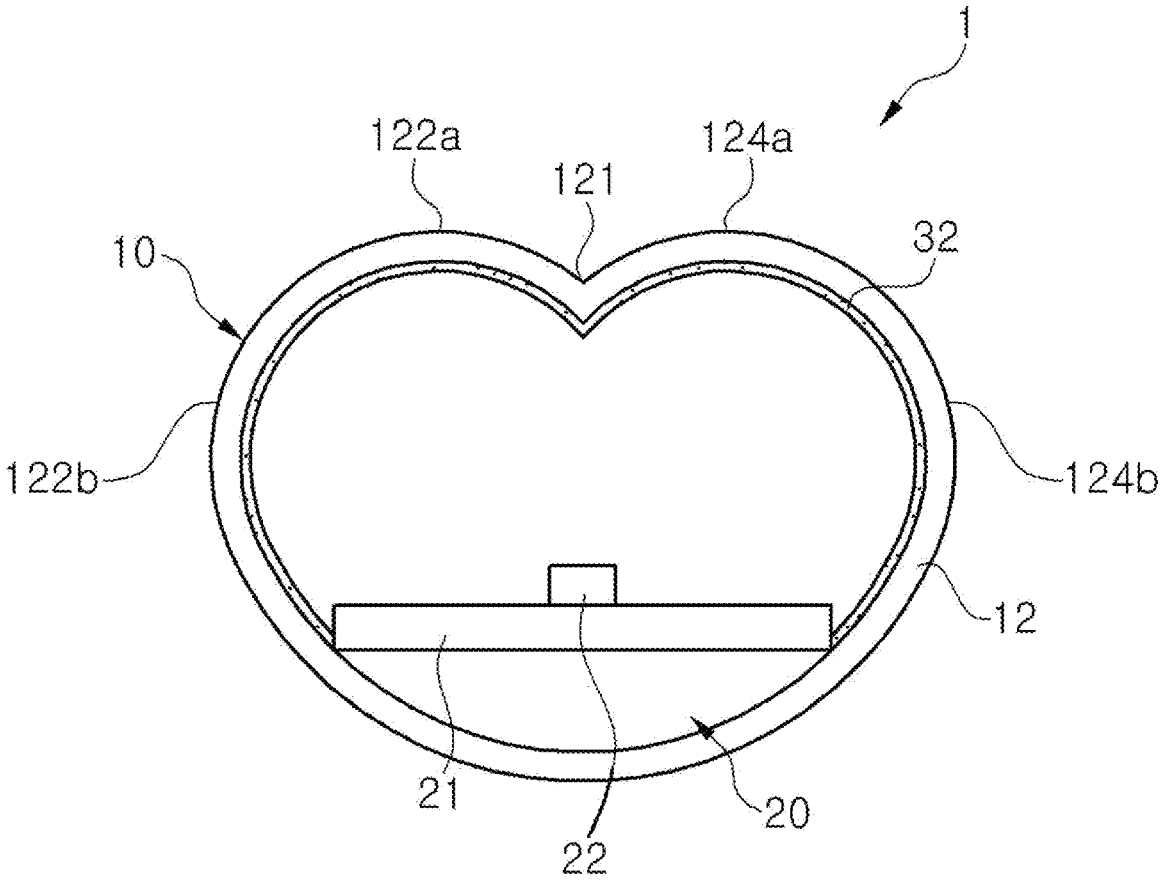

FIG. 10 shows a configuration in which the phosphor 32 is formed in a layer covering an inner surface of the tube 12 in front of the LED array 20. Various methods for forming the phosphor 32 on the inner surface of the tube 12 may be used. In particular, according to the material used for manufacturing the tube 12 and the kind of the applied material used together with the phosphor 32, the phosphor 32 may be formed uniformly on the inner surface of the tube 12 by an osmotic pressure process. Alternatively, the phosphor 32 may be applied to an outer surface of the tube 12.

Various LED 22-phosphor 32 combinations for generating white light or another light color may be used. Preferably, a combination of a blue LED and a yellow phosphor or yellow and green phosphors may be used for generating white light. Further, the color temperature of the light emitted by the LED lighting apparatus 1 may be adjusted if one or more LEDs 22 in the LED array 20 are configured to have peak wavelengths differing from the peak wavelengths of the other LEDs 22.

Figure 11:
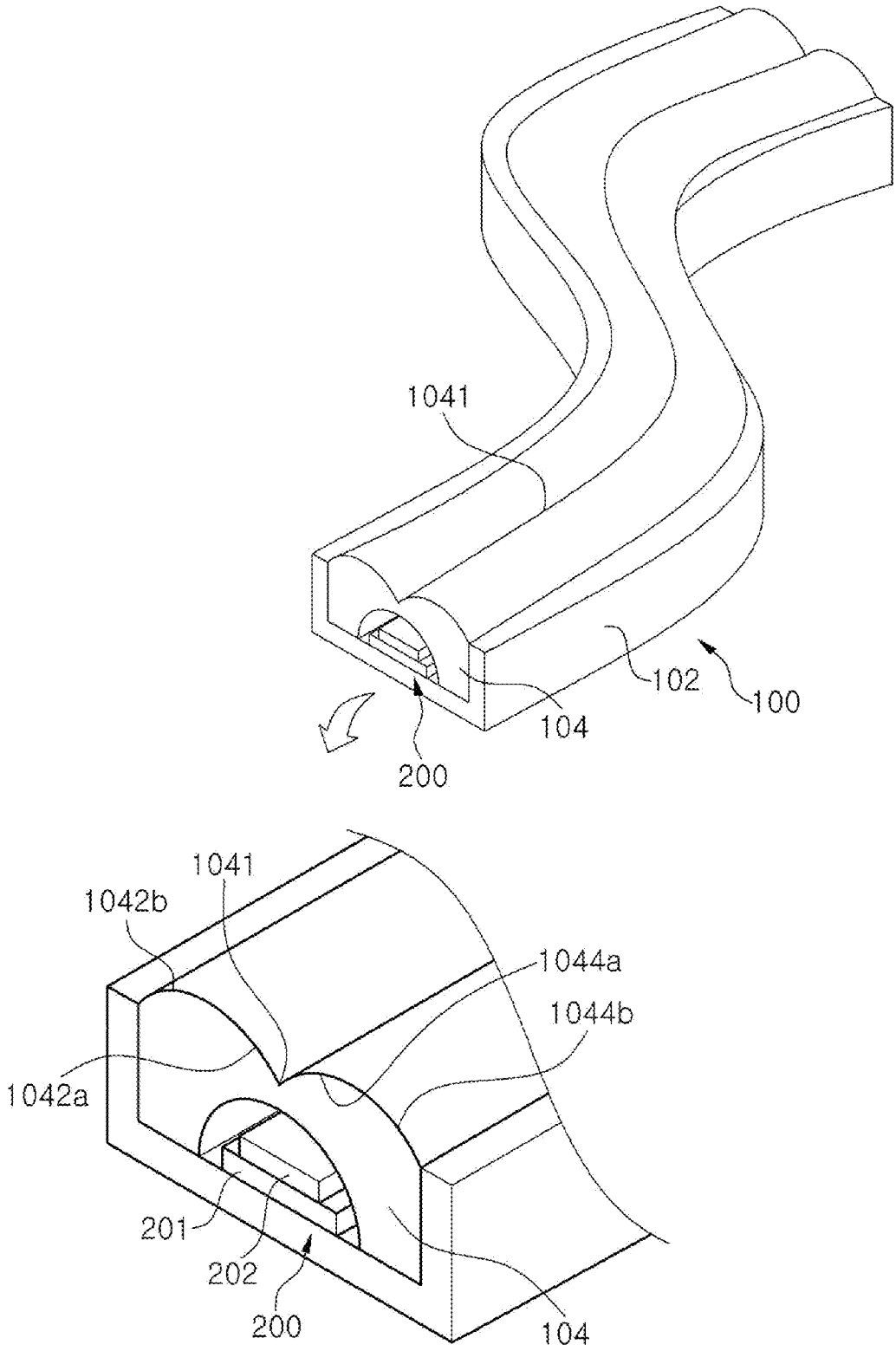
FIG. 11 is a partially cut-out perspective view of a channel-type LED lighting apparatus according to a further exemplary embodiment of the present invention.

FIG. 11 is a view showing a channel-type LED lighting apparatus according to a further exemplary embodiment of the present invention.

The tube-type LED lighting apparatus as described above may be used in applications similar to those that use a fluorescent lamp, i.e., for brightening and illuminating indoor environments. The channel-type LED lighting apparatus described below may be installed outdoors to brightly display letters, numerals, marks, images, symbols, and the like. Additionally, the channel-type LED lighting apparatus may be used for brightening and illuminating indoor environment similarly to the tube-type LED lighting apparatus as described above. Except for a variation in the configuration of the optical housing, the channel-type LED lighting apparatus has a configuration similar to that of the tube-type LED lighting apparatus. Since the conventional channel-type LED lighting apparatus has been referred to as "channel lighting" and chiefly used as an illumination device for advertising and promotional purposes, the channel-type LED lighting apparatus will be distinct from the tube-type LED lighting apparatus as described above.

Referring to FIG. 11, the channel-type LED lighting apparatus according to an exemplary embodiment of the present invention may be used to brightly display any letter shape, for example, for advertisement or promotion, and comprises an optical housing 100 having an "S"-shape and an LED array 200 arranged in the optical housing 100.

The optical housing 100 includes a channel member 102 having side walls and a bottom and an optical member 104 covering an open front face of the channel member 102. The LED array 200 is arranged in the space between the optical member 104 and the channel member 102, and the space may be filled with gas such as air or a light-transmissive resin material. If the space is filled with the light-transmissive resin material, the light-transmissive resin material may contain a phosphor for converting the wavelength of the light. The light-transmissive resin material is preferably the same material as the optical member 104 or another material whose refractive index is similar to that of the optical member 104.

A front surface of the optical member 104, i.e., a light emission surface, extends in the form of two peak-shaped convex portions that face each other. Accordingly, a substantially "S"-shaped valley line 1041 extends between the two convex portions. Further, first and second inner ridges 1042*a* and 1044*a*, which are the two inner-most portions of the two convex portions, extend longitudinally on both side of the valley line 1041. In addition, first and second outer ridges 1042*b* and 1044*b*, which are the two outer-most portions of the two convex portions, are formed to face to the first and second inner ridges 1042*a* and 1044*a*, respectively.

The LED array 200 includes a plurality of LEDs 202 mounted on an "S"-shaped printed circuit board (PCB) 201 at regular intervals. Further, a virtual array line (not shown) may align the centers of the LEDs 202 in an "S"-shaped line to match the valley line 1041 as described above. In this exemplary embodiment, the valley line 1041 and the virtual array line may be changed depending on the shape to be displayed by the LED lighting apparatus, i.e., depending on the shape of letters, numerals, symbols, and marks that the LED lighting apparatus illuminates. The LEDs 202 in the LED array 200 are positioned behind the valley line 1041 of the optical member 104, and, therefore, the centers of the LEDs 202 in the LED array 200 are vertically aligned with the valley line 1041. Accordingly, by means of the optical housing 100 including the valley line 1041, the first and second inner ridges 1042*a* and 1044*a*, and the LED array 200 arranged along the valley line 1041, the channel-type LED lighting apparatus may emit light with a widened light emission angular distribution similar to the tube-type LED lighting apparatus described above in exemplary embodiments.

The PCB 201, used for electrically connecting the LEDs 202, may be a rigid PCB, a flexible PCB (FPCB), or an electric wire. If an electric wire is employed, the LEDs 202 may be arranged on a bottom of the channel member 102, another base member, or a layer.

Figure 12:
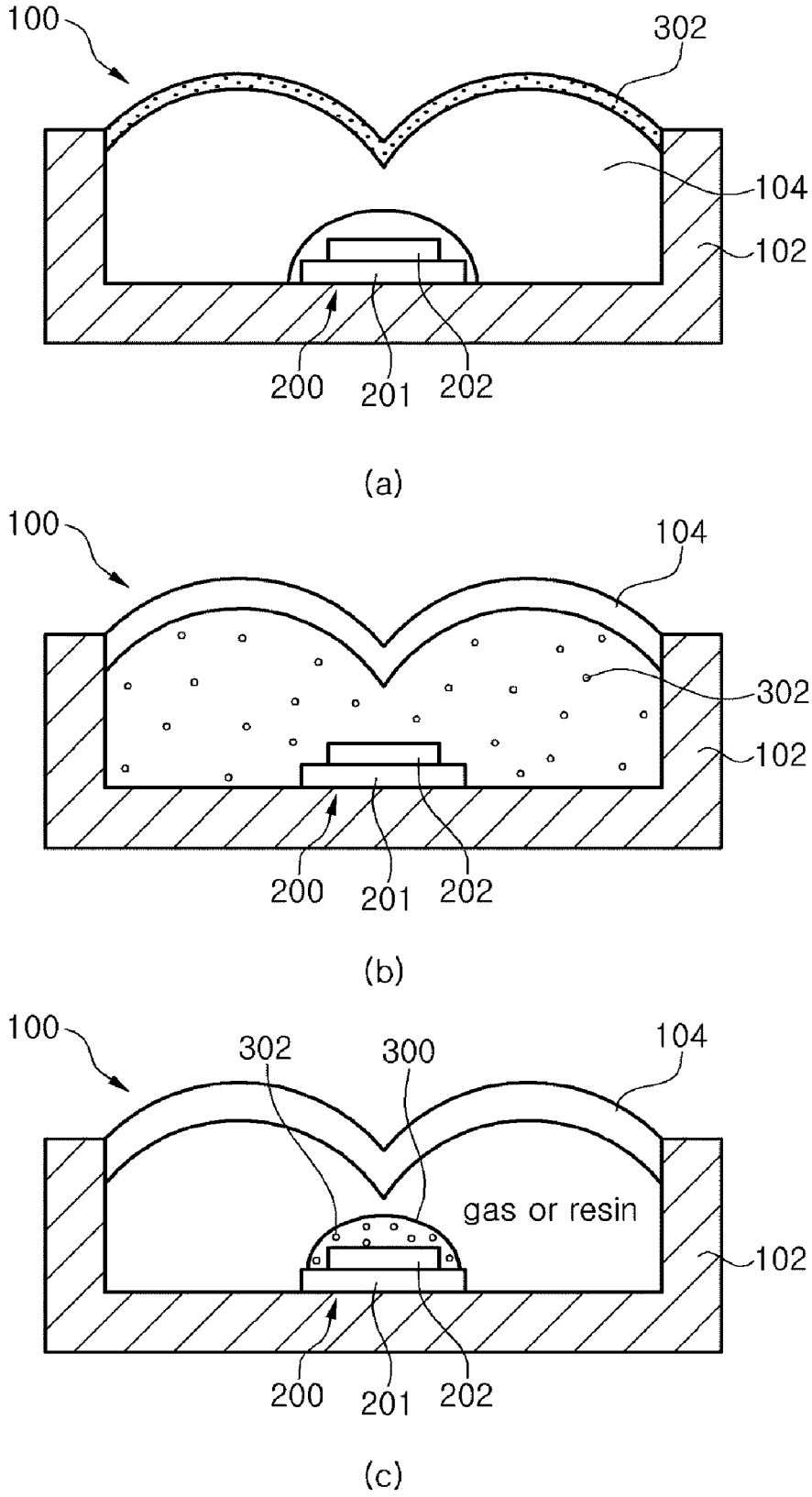
FIG. 12(*a*), FIG. 12(*b*), and FIG. 12(*c*) are cross-sectional views showing various exemplary embodiments of the channel-type LED lighting apparatus.

FIG. 12(*a*), FIG. 12(*b*), and FIG. 12(*c*) are cross-sectional views showing a variety of exemplary embodiments of the present invention.

FIG. 12(*a*) shows a channel-type LED lighting apparatus in which a phosphor 302 with uniform thickness is formed on an outer surface of the optical member 104, and FIG. 12(*b*) shows the configuration in which the space between the optical member 104 and the channel member 102 is filled with a resin material containing a phosphor 302, and the optical member 104 is disposed on top of the light-transmissive resin material. In addition, FIG. 12(*c*) shows that a resin or molding portion 300 for covering individually or entirely the LEDs 202 in the LED array 200 is formed on the bottom of the channel member or on the PCB 201 formed on the bottom of the channel member. The phosphor 302 may be uniformly formed on the surface of the resin or molding portion 300 in the dual molding manner or may be contained in the resin material as described above, and the optical member 104 is arranged to cover the open front face of the channel member 102.

Figure 13A:
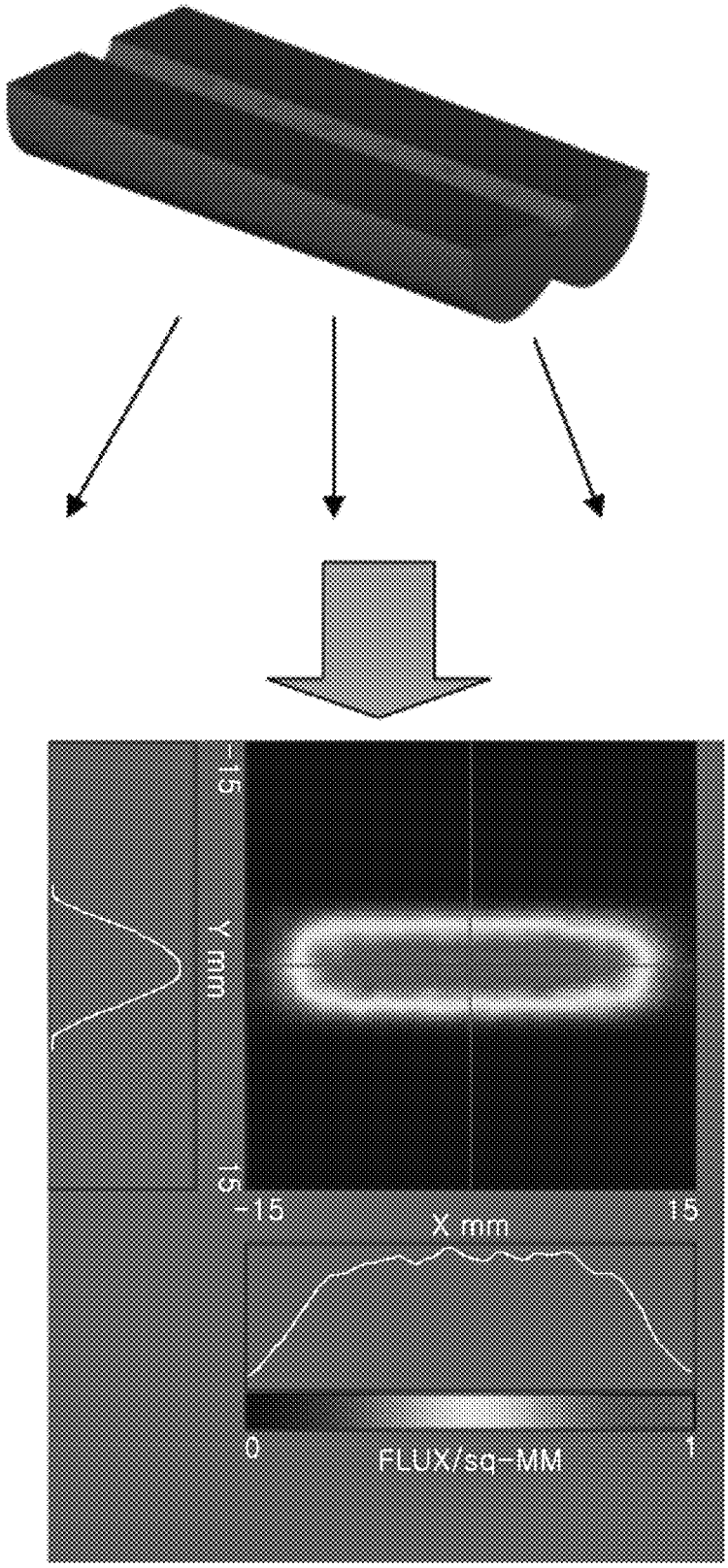
FIG. 13*a* is a view showing the illumination angular distribution obtained by using an optical housing according to an exemplary embodiment of the present invention.

FIG. 13*a* is a view showing the illumination angular distribution that may be obtained in a case where the LED lighting apparatus according to an exemplary embodiment of the present invention employs the optical housing as described above, and FIG. 13*b* is a view showing the illumination angular distribution that may be obtained in a comparative example without the optical housing.

Referring to FIG. 13*a*, since the lighting apparatus according to the present invention employs the optical housing having the configuration as described above, it is possible to obtain an illumination angular distribution that is uniform in the lengthwise direction at the front (in particular, a portion near the bottom of the interior space as shown in FIG. 13*a*) of the lighting apparatus. In other words, the illumination angular distribution is largely unaffected by a location of the LED within the optical housing since the light emission is fairly constant along the longitudinal and transverse axes of the lighting apparatus. As shown in the illumination graph in the lower part of FIG. 13*a*, the lighting apparatus according to an exemplary embodiment of the present invention may have a substantially similar illumination angular distribution as an elongated surface light source such as a fluorescent lamp.

Figure 13B:
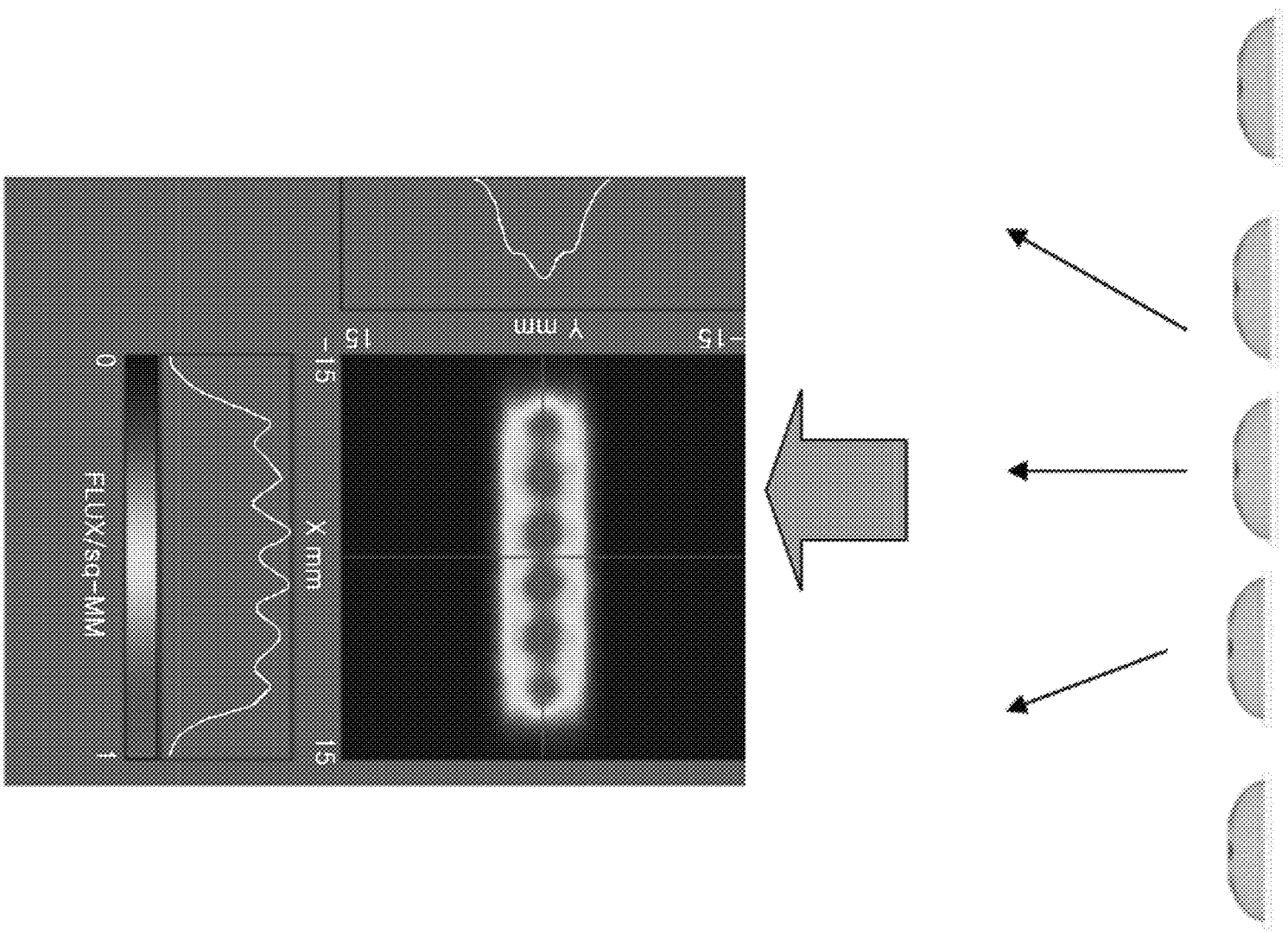
FIG. 13*b* is a view showing the illumination angular distribution obtained in a comparative example without using the optical housing of FIG. 13*a*.

Referring to FIG. 13*b*, when the aforementioned optical housing is removed from the lighting apparatus, the illumination angular distribution exhibits multimodal intensity variations along the longitudinal axis of the lighting apparatus. As demonstrated by the data plots in FIG. 13*a* and FIG. 13*b*, the optical housing employed in exemplary embodiments of the present invention changes the illumination angular distribution. By using an optical housing as described above, the illumination angular distribution of a plurality of near-point light sources may approximate the illumination angular distribution obtained from one elongated surface light source.

According to exemplary embodiments of the present invention, light losses caused by internal reflection of LED light incident upon curved surfaces may be mitigated. Further the narrow light emission angular distribution of conventional tube-type LED lighting apparatus may be improved. Accordingly, a tube-type or channel-type LED lighting apparatus capable of reducing light losses and having a wider light emission angular distribution may be implemented and may be suitable for brightening and illuminating interior spaces and also for advertisement lighting. Moreover, exemplary embodiments of the present invention may prevent or decrease phosphor degradation in an LED lighting apparatus in which the phosphor is included in an LED (particularly an LED package article) by positioning the phosphor in or onto a tube and separated from the LED.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A light emitting diode (LED) lighting apparatus, comprising:

an optical housing comprising a light emission surface, the optical housing being either a channel-type optical housing or a tube-type optical housing; and an LED array arranged in the optical housing, wherein the light emission surface comprises a valley line, a first inner ridge, and a second inner ridge, the first inner ridge and the second inner ridge being disposed on opposing sides of the valley line, and the LED array comprises a plurality of LEDs arranged so that a center of each LED is arranged along the valley line, and wherein an internal space of the optical housing is filled with a gas or a light-transmissive material, at least a portion of the optical housing being light-transmissive.

2. The LED lighting apparatus of claim 1, wherein the shapes of the first inner ridge and the second inner ridge comprise convex curves that are symmetric to each other with respect to the valley line.

3. The LED lighting apparatus of claim 2, wherein the light emission surface further comprises:

a first outer ridge; and a second outer ridge, wherein the first outer ridge and the second outer ridge face the first inner ridge and the second inner ridge, respectively, and the shapes of the first outer ridge and the second outer ridge comprise convex curves.

4. The LED lighting apparatus of claim 1, wherein the shapes of the first inner ridge and the second inner ridge comprise slanted flat surfaces that are symmetric to each other with respect to the valley line.

5. The LED lighting apparatus of claim 4, wherein the light emission surface further comprises:

a first outer ridge; and a second outer ridge, wherein the first outer ridge and the second outer ridge face the first inner ridge and the second inner ridge, respectively, and the shapes of the first outer ridge and the second outer ridge comprise convex curves.

6. The LED lighting apparatus of claim 1, wherein the optical housing is the tube-type optical housing, and the tube-type optical housing comprises:

an integral-type tube or an assembling-type tube filled with the gas or the light-transmissive material.

7. The LED lighting apparatus of claim 1, wherein the optical housing is the channel-type optical housing, and the channel-type optical housing comprises:

a channel member comprising side walls and a bottom, the LED array being arranged on the bottom of the channel member; and a light-transmissive optical member covering at least a front surface of the channel member to form the light emission surface.

8. The LED lighting apparatus of claim 1, further comprising:

a light-transmissive molding portion covering the LEDs individually or entirely, wherein the molding portion comprises a phosphor.

9. The LED lighting apparatus of claim 1, further comprising:

a light-transmissive molding portion covering the LEDs individually or entirely, wherein a phosphor is disposed on a surface of the light-transmissive molding portion.

10. The LED lighting apparatus of claim 1, further comprising a phosphor disposed on the light emission surface.

11. The LED lighting apparatus of claim 1, wherein the optical housing is the channel-type optical housing, and the channel-type optical housing further comprises:

a channel member comprising side walls and a bottom, the LED array being arranged on the bottom of the channel member; and a light-transmissive optical member covering at least a front surface of the channel member to form the light emission surface, wherein a phosphor is disposed on the light-transmissive optical member.

12. The LED lighting apparatus of claim 1, wherein each of the LEDs comprises an LED package or a bare LED chip disposed on a printed circuit board (PCB) or a flexible printed circuit board (FPCB).

13. The LED lighting apparatus of claim 1, wherein the LED array further comprises a printed circuit board (PCB) or a flexible printed circuit board (FPCB), the plurality of LEDs being disposed on the PCB or FPCB, and the plurality of LEDs being electrically connected by the PCB or FPCB.

14. The LED lighting apparatus of claim 1, wherein the LED array comprises wires electrically connecting the plurality of LEDs.

15. A light emitting diode (LED) lighting apparatus, comprising:

an optical housing comprising a light emission surface, the optical housing being either a channel-type optical housing or a tube-type optical housing; and an LED array arranged in the optical housing, wherein the light emission surface comprises a valley line, a first inner ridge, and a second inner ridge, the first inner ridge and the second inner ridge being disposed on opposing sides of the valley line, and the LED array comprises a plurality of LEDs arranged so that a center of each LED is arranged along the valley line, and wherein the shapes of the first inner ridge and the second inner ridge comprise slanted flat surfaces that are symmetric to each other with respect to the valley line.

16. The LED lighting apparatus of claim 15, wherein the light emission surface further comprises:

a first outer ridge; and a second outer ridge, wherein the first outer ridge and the second outer ridge face the first inner ridge and the second inner ridge, respectively, and the shapes of the first outer ridge and the second outer ridge comprise convex curves.

17. A light emitting diode (LED) lighting apparatus, comprising:

an optical housing comprising a light emission surface, the optical housing being either a channel-type optical housing or a tube-type optical housing; and an LED array arranged in the optical housing, wherein the light emission surface comprises a valley line, a first inner ridge, and a second inner ridge, the first inner ridge and the second inner ridge being disposed on opposing sides of the valley line, and the LED array comprises a plurality of LEDs arranged so that a center of each LED is arranged along the valley line, and wherein the optical housing is the channel-type optical housing, and the channel-type optical housing further comprises:

a channel member comprising side walls and a bottom, the LED array being arranged on the bottom of the channel member; and a light-transmissive optical member covering at least a front surface of the channel member to form the light emission surface, a phosphor being disposed on the light-transmissive optical member.

* * * * *